US007914629B2

(12) United States Patent
Nakashima et al.

(10) Patent No.: US 7,914,629 B2
(45) Date of Patent: Mar. 29, 2011

(54) HIGH STRENGTH THICK STEEL PLATE SUPERIOR IN CRACK ARRESTABILITY

(75) Inventors: Kiyotaka Nakashima, Tokyo (JP); Masanori Minagawa, Tokyo (JP); Kouji Ishida, Tokyo (JP); Akira Ito, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 358 days.

(21) Appl. No.: 12/296,893

(22) PCT Filed: Apr. 13, 2007

(86) PCT No.: PCT/JP2007/058568

§ 371 (c)(1),
(2), (4) Date: Oct. 10, 2008

(87) PCT Pub. No.: WO2007/119878

PCT Pub. Date: Oct. 25, 2007

(65) Prior Publication Data

US 2009/0092515 A1 Apr. 9, 2009

(30) Foreign Application Priority Data

Apr. 13, 2006 (JP) ..... 2006-110590
Mar. 15, 2007 (JP) ..... 2007-066716

(51) Int. Cl.
*C22C 38/08* (2006.01)

(52) U.S. Cl. ..... 148/336; 148/331; 148/332; 148/333; 148/335; 420/90; 420/91; 420/92; 420/119; 428/547; 428/610

(58) Field of Classification Search ..... 148/336, 148/331–333, 335; 428/547, 610; 420/119, 420/90–92
See application file for complete search history.

(56) References Cited

U.S. PATENT DOCUMENTS

2003/0217795 A1 11/2003 Asahi et al.

FOREIGN PATENT DOCUMENTS

JP 59-47323 A 3/1984
(Continued)

OTHER PUBLICATIONS

O. Engler et al., "A Study of Through-Thickness Texture Gradients in Ro ed Sheets", Metallurgical and Materials Transactions, vol. 31A, Sep. 2000, pp. 2299-2315.

*Primary Examiner* — Sikyin Ip
(74) *Attorney, Agent, or Firm* — Birch, Stewart, Kolasch & Birch, LLP

(57) ABSTRACT

The present invention provides high strength thick steel plate superior in crack arrestability high in strength, free of deterioration of HAZ toughness, and free of anisotropy, that steel plate containing, by mass %, C: 0.03 to 0.15%, Si: 0.1 to 0.5%, Mn: 0.5 to 2.0%, P: ≦0.02%, S: ≦0.01%, Al: 0.001 to 0.1%, Ti: 0.005 to 0.02%, Ni: 0.15 to 2%, and N: 0.001 to 0.008% and having a balance of iron and unavoidable impurities as chemical components, having a microstructure of a ferrite and/or pearlite structure with bainite as a matrix phase, and having an average circle equivalent diameter of crystal grains with a crystal misorientation angle of 15° or more of 15 μm or less in the regions of 10% of plate thickness from the front and rear surfaces and of 40 μm or less in the other region including the center part of plate thickness.

7 Claims, 3 Drawing Sheets

FOREIGN PATENT DOCUMENTS

| | | | | |
|---|---|---|---|---|
| JP | 61-235534 | A | | 10/1986 |
| JP | 2001-123245 | A | | 5/2001 |
| JP | 2002-241891 | A | | 8/2002 |
| JP | 2003-221619 | A | | 8/2003 |
| JP | 2003-239036 | A | | 8/2003 |
| JP | 2003239036 | A | * | 8/2003 |
| JP | 2005-54250 | A | | 3/2005 |
| JP | 2005-097683 | A | | 4/2005 |
| JP | 2005-097694 | A | | 4/2005 |
| KR | 2003-0081050 | A | | 10/2003 |

* cited by examiner

HIGH STRENGTH THICK STEEL PLATE SUPERIOR IN CRACK ARRESTABILITY

TECHNICAL FIELD

The present invention relates to high strength thick steel plate superior in crack arrestability.

BACKGROUND ART

Thick steel plate used for shipbuilding, construction, tanks, marine structures, line pipe, and other structures are being required to exhibit the ability to suppress propagation of brittle fractures, that is, crack arrestability, in order to suppress the brittle fractures of such structures. In recent years, along with the enlargement of structures, high strength thick steel plate with a yield stress of 390 MPa to 500 MPa and a plate thickness of 40 mm to 100 mm is being used in increasing cases. However, in general, strength and plate thickness are contradictory in the crack arrestability. The above crack arrestability falls along with an increase in the strength and the plate thickness. For this reason, technology for improving the crack arrestability in high strength thick steel plate is desired.

As technology for improving the crack arrestability, for example, the method of controlling the crystal grain size, the method of controlling the brittle second phase, and the method of controlling the texture are known.

As the method of controlling the crystal grain size, the technology described in Japanese Patent Publication (A) No. 61-235534, Japanese Patent Publication (A) No. 2003-221619, and Japanese Patent Publication (A) No. 5-148542 is known. This uses ferrite as the matrix phase and makes the ferrite finer so as to improve the crack arrestability.

Further, as the method of controlling the brittle second phase, there is the technology described in Japanese Patent Publication (A) No. 59-49323. This disperses a fine brittle second phase (for example, martensite) in the ferrite forming the matrix phase so as to cause fine cracks in the brittle second phase at the front ends of the brittle cracks and thereby release the stress conditions at the crack tips.

Further, as the method of controlling the texture, there is the technology described in Japanese Patent Publication (A) No. 2002-241891. This promotes the formation of a {211} plane texture parallel to the rolled surface in ultralow carbon (C<0.003%) bainite single phase steel.

However, these technologies have the following problems.

The technology of controlling the grain size uses soft ferrite as a matrix phase, so obtaining a high strength thick steel plate is difficult.

Further, with the technology of controlling the brittle second phase, martensite is dispersed in the ferrite, so the crack initiation property of the brittle fracture ends up remarkably deteriorating.

Further, since ferrite is used as the matrix phase, obtaining high strength thick steel plate is difficult in the same way.

Further, in the technology for controlling the texture, ultralow carbon steel is used and the structure is made a bainite single phase to promote the formation of a uniform texture in the plate thickness direction, so the crack arrestability cannot be remarkably improved. Further, the load required for steelmaking for obtaining ultralow carbon steel is extremely large.

DISCLOSURE OF THE INVENTION

The present invention was made in consideration of the above situation and has as its object the ability to provide high strength thick steel plate superior in crack arrestability which is high in strength, free of deterioration of the HAZ (heat affected zone) toughness, and free of anisotropy, at a low manufacturing cost.

To achieve the above object, the high strength thick steel plate according to the present invention is as follows:

(1) High strength thick steel plate containing, by mass %, C: 0.03 to 0.15%, Si: 0.1 to 0.5%, Mn: 0.5 to 2.0%, P: ≦0.02%, S: ≦0.01%, Al: 0.001 to 0.1%, Ti: 0.005 to 0.02%, Ni: 0.15 to 2%, and N: 0.001 to 0.008% and having a balance of iron and unavoidable impurities as chemical components, having a microstructure of a ferrite and/or pearlite structure with bainite as a matrix phase, and having an average circle equivalent diameter of crystal grains with a crystal misorientation angle of 15° or more of 15 μm or less in the regions of 10% of plate thickness from the front and rear surfaces and of 40 μm or less in the other region including the center part of plate thickness.

(2) High strength thick steel plate superior in crack arrestability as set forth in (1) characterized by further containing, by mass %, one or more of Cu: 0.1 to 1%, Cr: 0.1 to 1%, Mo: 0.05 to 0.5%, Nb: 0.005 to 0.05%, V; 0.02 to 0.15%, and B: 0.0003 to 0.003% as chemical components.

(3) High strength thick steel plate superior in crack arrestability as set forth in (1) or (2) characterized by further containing, by mass %, one or more of Ca: 0.0003 to 0.005%, Mg: 0.0003 to 0.005%, and REM: 0.0003 to 0.005% as chemical components.

(4) High strength thick steel plate superior in crack arrestability as set forth in any one of (1) to (3) characterized in that {100} planes forming an angle of ±15° with respect to a plane vertical to loading direction have an area ratio of 30% or less in said regions of 10% of plate thickness from the front and rear surfaces.

(5) High strength thick steel plate superior in crack arrestability as set forth in any one of (1) to (4) characterized in that said {100} planes forming an angle of ±15° with respect to the plane vertical to loading direction have an area ratio of 15% or less in said regions including the center part of plate thickness other than said regions of 10% of plate thickness from the front and rear surfaces.

(6) High strength thick steel plate superior in crack arrestability as set forth in any one of (1) to (5) characterized in that the plate thickness is 40 mm or more.

(7) High strength thick steel plate superior in crack arrestability as set forth in any one of (1) to (6) characterized in that the yield stress is 390 MPa or more.

According to the present invention, the steel plate becomes extremely superior in crack arrestability, high in strength even if thick in plate thickness, and free of deterioration in HAZ toughness, so it becomes possible to lower the cost and improve the safety of welded steel structures.

BEST MODE FOR CARRYING OUT THE INVENTION

Below, embodiments of the present invention will be explained. The high strength thick steel plate according to the present embodiment has a microstructure comprised of a ferrite and/or pearlite structure with bainite as the matrix phase and is controlled in crystal grain size and texture in the plate thickness direction so is improved in the crack arrestability.

The reason for making bainite the matrix phase is to obtain steel plate with a thick plate thickness and a high strength. With ferrite as the matrix phase, obtaining such a steel plate is difficult. If making bainite the matrix phase enables steel plate of the desired plate thickness and strength to be obtained, the ferrite and/or pearlite may also be made the second phase.

In general, the grain size of bainite depends on the grain size of austenite before transformation to bainite. For this reason, making the grain size of the bainite finer is difficult. As opposed to this, the inventors engaged in intensive studies and as a result learned that by making the amount of addition of Ni a suitable value, it is possible to make the grain size of the bainite finer.

Figure 1:
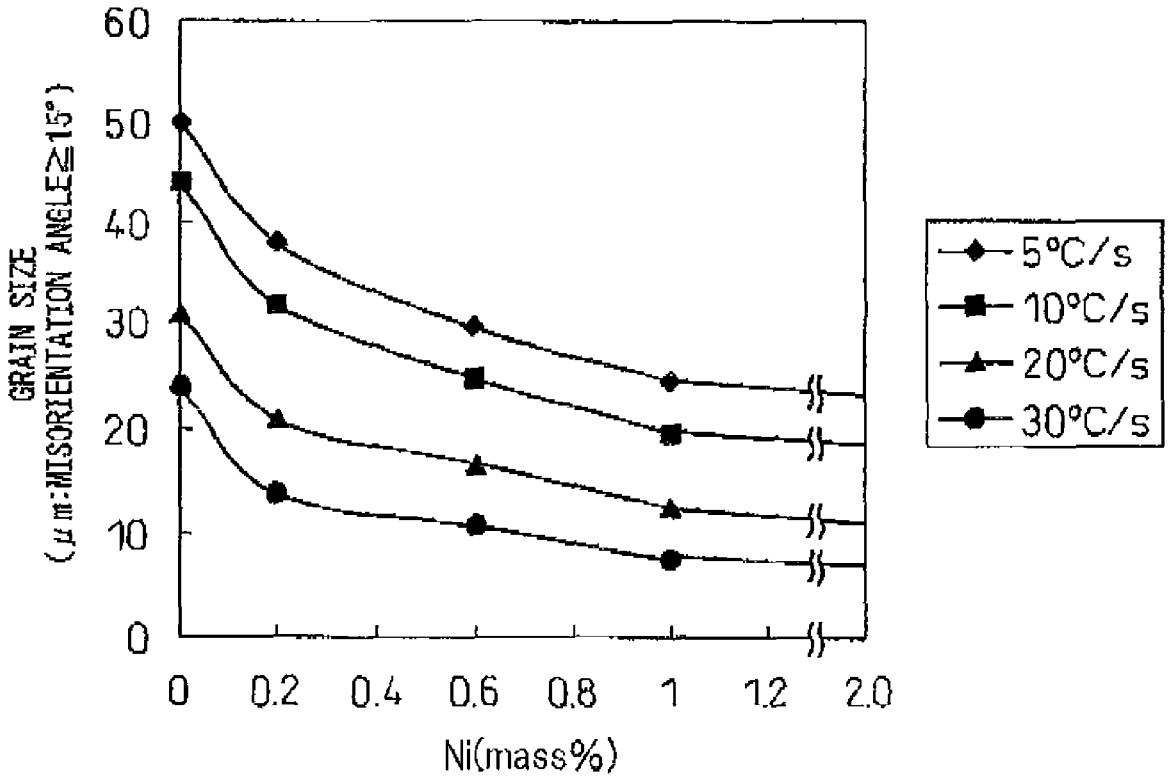
FIG. 1 is a view showing the relationship between the amount of addition of Ni and the crystal grain size.

The graph of FIG. 1 shows the relationship between the amount of addition of Ni and the average circle equivalent diameter of the crystal grains having a crystal misorientation angle of 15° or more in a bainite structure (crystal grain size) in the case of changing the cooling rate after hot rolling to 5 to 30° C./s. The chemical components other than Ni are, by mass %, C: 0.01%, Si: 0.2%, Mn: 1.3%, P: 0.005%, S: 0.003%, Al: 0.03%, Ti: 0.01%, and N: 0.003%. From this graph, it reveals that if increasing the amount of Ni added, the crystal grains become finer and further if increasing the cooling rate, the crystal grains become finer.

The cooling rate of steel plate of a plate thickness of over 40 mm is often about 30° C./s at the regions of 10% of plate thickness from the front and rear surfaces of the steel plate (hereinafter referred to as "the surface layer parts of the steel plate"). In this case, the region other than the surface layer parts of the steel plate including the center part of plate thickness (below, called the "center part of the steel plate"), it is often about 50° C./s. The fact that when making the amount of Ni added 0.15% or more at this cooling rate, the crystal grain sizes at the surface layer parts of the steel plate and the center part of the steel plate become 15 μm or less and 40 μm or less can be read from FIG. 1.

Further, in this way, it was learned that when the crystal grain size is 15 μm or less at the surface layer parts of the steel plate and is 40 μm or less at the center part of the steel plate, a high crack arrestability of a Kca at −10° C. of 170 $MPa \cdot m^{0.5}$ or more is exhibited.

Figure 2:
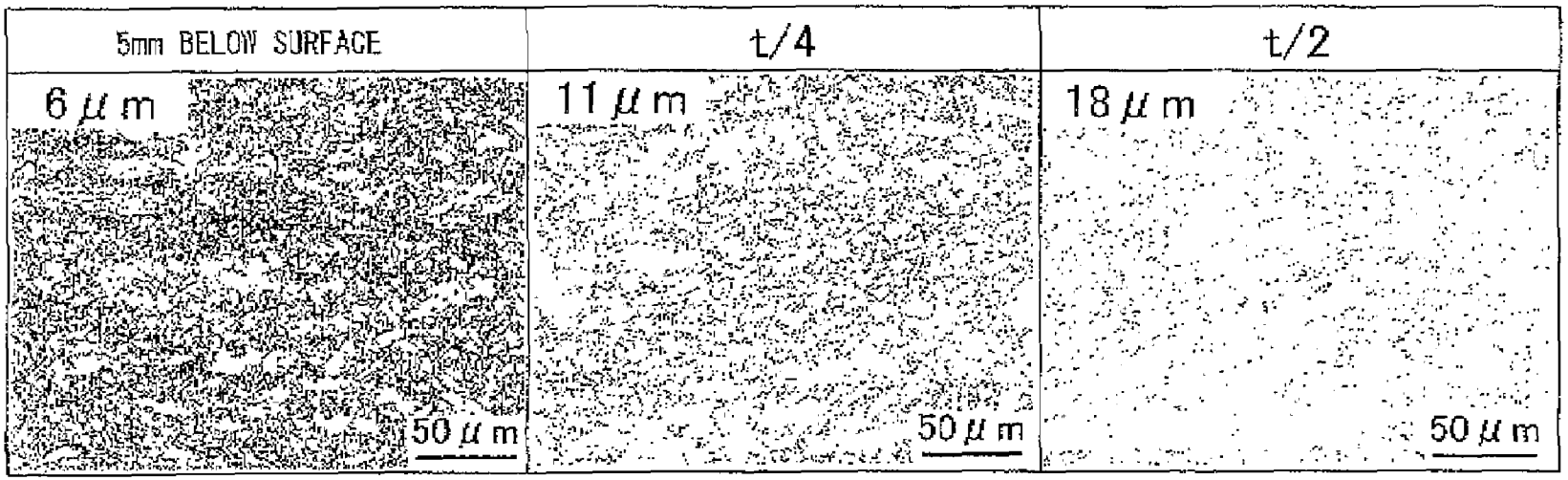
FIG. 2 is a view showing a grain boundary map obtained by measurement by the EBSP method.

FIG. 2 is a grain boundary map showing the measurement results by the EBSP method in thick steel plate of a plate thickness of 80 mm having as chemical components, by mass %, C: 0.08%, Si: 0.2%, Mn: 1.1%, P: 0.005%, S: 0.005%, Al: 0.01%, Ti: 0.008%, Ni: 1.0%, N: 0.002%, Nb: 0.015%, B: 0.001%, and Ca: 0.001%. In the example shown in FIG. 2, the crystal grain size is 6 μm at a portion positioned 5 mm below the surface of the steel plate, 11 μm at a portion positioned at ¼ the plate thickness from the surface, and 18 μm at a portion positioned at ½ of the plate thickness. Thick steel plate having a crystal grain size of 15 μm or less at the surface layer parts of the steel plate and of 40 μm or less at the center part of the steel plate exhibits a high crack arrestability of a Kca at −10° C. of 200 $MPa \cdot m^{0.5}$.

The finer the crystal grain size, the better the crack arrestability, but if considering the productivity, the lower limit of the crystal grain size is preferably 3 μm at the surface layer parts of the steel plate and 10 μm at the center part of the steel plate.

The reason why the crystal grain size becoming finer results in the crack arrestability becoming improved in this way is as follows: At the crystal grain boundary, the crystal orientation differs between adjoining crystal grains, so at this part the direction in which the crack propagates differs. For this reason, fracture-free regions occur. Due to the fracture-free regions, the stress is shared and becomes crack closure stress. Therefore, the driving force for crack propagation falls and the crack arrestability is improved. Further, the fracture-free regions finally fracture by ductile fracture, so the energy required for brittle fracture is absorbed. For this reason, the crack arrestability is improved.

In general, at the surface layer of thick steel plate, brittle fracture does not easily occur and a ductile fracture region (shear lip) easily forms. If the surface layer becomes finer grained and the thickness of the finer grain layer becomes greater, the shear lip region is enlarged. At the fracture-free region before formation of the shear lip, the stress is shared and becomes crack closure stress. Further, the energy required for brittle fracture is absorbed by formation of the shear lip. For this reason, the crack arrestability is improved.

The reason for making the crystal misorientation angle with adjoining grains 15° or more is that if less than 15°, the crystal grain boundaries do not easily become resistance to propagation of the brittle cracks and the above effect of improvement of the crack arrestability is reduced. Further, the reason for making the crystal grain size of the surface layer parts of the steel plate 15 μm or less is that if over 15 μm, the toughness required for formation of a shear lip cannot be obtained. The reason for making the crystal grain size of the center part of the steel plate 40 μm or less is that if over 40 μm, the toughness falls, propagation of brittle cracks inside the plate thickness becomes dominant, and the driving force for fractures at the surface layer parts becomes larger, whereby shear lips become harder to form.

On the other hand, the brittle cracks occurring at the steel plate propagate along the cleavage plane of the {100} plane, so it is learned that if a {100} plane texture develops at the plane vertical to the loading direction, the effect of improvement of the crack arrestability when controlling the crystal grain size in this way ends up being reduced.

At this time, if the texture of the {100} plane forming an angle of ±15° with respect to the plane vertical to the loading direction becomes, by area ratio, 30% or less at the regions of 10% plate thickness from the front and rear surfaces (surface layer parts of the steel plate), it is learned that the effect of improvement of the crack arrestability due to the increased fineness of the crystal grain size can be exhibited and a sufficient value of the crack arrestability is shown. Further, at the region other than the surface layer parts of the steel plate including the center part of plate thickness (center part of the steel plate), it is learned that if making the area ratio of the texture 15% or less, the effect of improvement of the crack arrestability due to the increased fineness of the crystal grain size can be exhibited and a sufficient value of the crack arrestability is shown.

Figure 3:
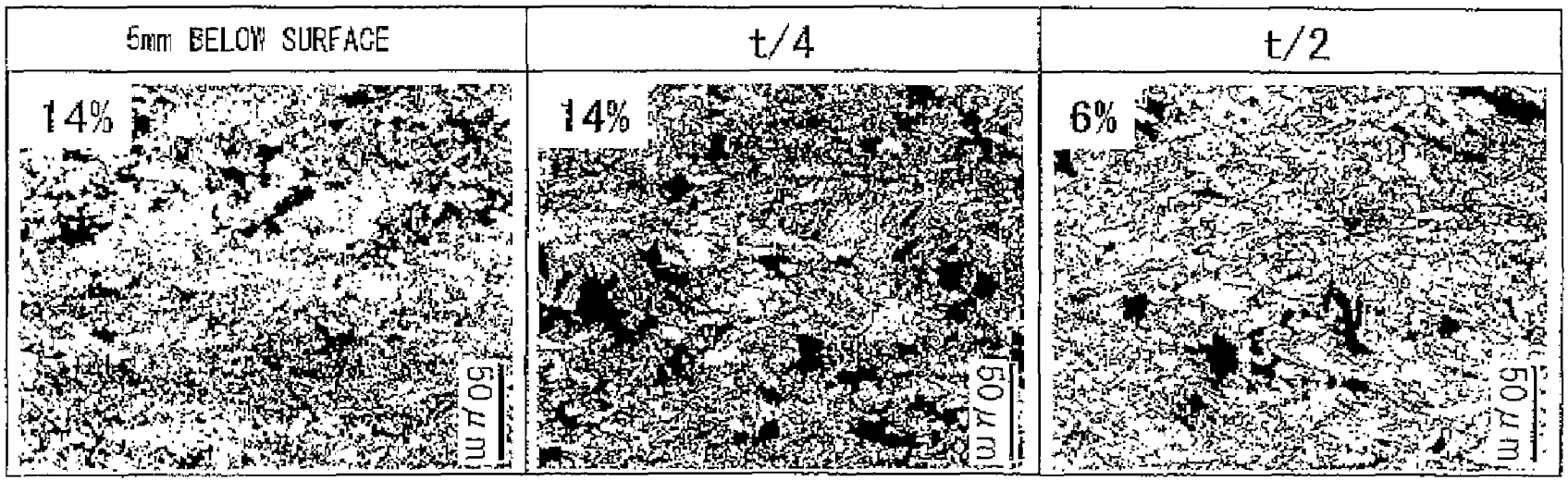
FIG. 3 is a view showing a {100} plane map obtained by measurement by the EBSP method.

FIG. 3 is a map of the {100} plane showing the measurement results by the EBSP method in thick steel plate used at FIG. 2. In the example shown in FIG. 3, the black parts are {100} planes forming an angle of ±15° with respect to the plane vertical to the external stress. The area ratio of the {100} planes is 14% at the position 5 mm below the surface of the steel material, 14% at a portion positioned at ¼ of the plate thickness from the surface, and 6% at a portion positioned at ½ of the plate thickness. Thick steel plate with a {100} area ratio of 30% or less at the surface layer parts of the steel plate and 15% or less at the center part of the steel plate in this way, as explained above, exhibits a high crack arrestability of a Kca at −10° C. of 200 MPa·m$^{0.5}$. Further, if observing the fracture surface of the test piece, a shear lip of about 10% of the plate thickness was observed at the surface layer parts.

The smaller the area ratio of the {100} planes, the better the crack arrestability, but if extremely small, the other texture grows and anisotropy ends up occurring in the crack arrestability, so the ratio for the steel plate surface layer parts is preferably 5% or more and for the steel plate center part is 3% or more.

The above effect of improvement of the crack arrestability is particularly remarkable in steel plate with a yield stress of 390 to 500 MPa and steel plate with a plate thickness of 40 to 100 mm. The reason is that in the region where the yield stress is less than 390 MPa or over 500 MPa and the plate thickness is less than 40 mm or over 100 mm, it is difficult to form a distribution where the crystal grain size or texture differ in the plate thickness direction such as prescribed in the present invention.

Below, the reasons for limiting the amounts of the elements will be explained.

C has to be 0.03% of more to secure the strength and toughness of the thick steel plate. This is the lower limit. Further, if C exceeds 0.15%, it is difficult to secure a good HAZ toughness, so this becomes the upper limit.

Si is effective as a deoxidizing element and strengthening elements, so 0.1% or more is necessary, but if over 0.5%, the HAZ toughness greatly deteriorates, so this is the upper limit.

Mn has to be 0.5% or more so as to economically secure strength and toughness of the thick-gauge matrix material. However, if Mn is added over 2.0%, the center segregation becomes remarkable. The matrix material at this part and the HAZ toughness deteriorate, so this is the upper limit.

P is an impurity element and has to be reduced to 0.02% or less to stably secure the HAZ toughness.

Further, S is also an impurity element and has to be reduced to 0.01% or less to stably secure the characteristics of the matrix material and HAZ toughness.

Al functions for deoxidation and is required for reducing the impurity element O. In addition to Al, Mn and Si also contribute to the deoxidation, but even if these elements are added, if 0.001% or more of Al is not present, it is difficult to stably suppress O. However, if Al is over 0.1%, alumina-based coarse oxides and their clusters are formed and the matrix material and HAZ toughness are impaired, so this is made the upper limit.

Ti is important in the present invention. By adding Ti, TiN is formed and it is possible to keep the austenite grains from becoming larger in size at the time of heating the steel slab. As explained above, if the austenite grain site becomes larger, the grain size of the bainite after the transformation also becomes larger, so to obtain the necessary size of the bainite grains, Ti has to be added in an amount of 0.005% or more. However, excessive Ti addition invites a drop in the HAS toughness due to the formation of TiC, so 0.02% was made the upper limit.

Ni is the most important in the present invention. By controlling the amount of addition of Ni to a suitable value in this way and controlling the cooling rate in the process of cooling the steel plate, in the above way, the subunits of the bainite, that is, the crystal grains when defining the boundary where the crystal misorientation angle is 15° or more as the grain boundary, can be made finer. To exhibit this effect, the amount of angle of Ni has to be 0.15% or more. However, Ni is an expensive element. Excessive addition is costly. Further, there is also an upper limit to the effect of addition of Ni, so 2% is preferably made the upper limit.

N is important in the present invention. As explained above, TiN has to be formed in the steel material, so 0.001% is made the lower limit. On the other hand, if the amount of addition of N becomes excessive, embrittlement of the steel material is incurred, so 0.008% is made the upper limit.

Further, in addition to the above added elements, by mass %, one or more of Cu: 0.1 to 1%, Cr: 0.1 to 1%, Mo: 0.05 to 0.5%, Nb: 0.005 to 0.05%, V: 0.02 to 0.15%, and B: 0.0003 to 0.003% may be included as chemical components. By adding these in the lower limits or more, the strength and toughness of the matrix material are secured. However, if these elements are too great, the HAZ toughness and weldability fall, so it is necessary to set upper limits to these elements.

Further, in addition to the above added elements, one or more of, by mass %, Ca: 0.0003 to 0.005%, Mg: 0.0003 to 0.005%, and REM: 0.0003 to 0.005% may be included as chemical components. By adding these, the HAZ toughness is secured.

Next, a preferable method of production of high strength thick steel plate of the present invention will be explained. First, molten steel adjusted to the above suitable chemical components is produced by a known steelmaking method such as a converter and made into a steel material, that is, a cast slab, by continuous casting or another normal casting method. During the cooling at the time of casting or after the cooling, the steel slab is heated to a temperature of 950 to 1250° C. to make a single austenite phase. If this is performed at less than 950° C., the solubilization is insufficient, while if over 1250° C., the heated austenite becomes extremely coarse in grain size, obtaining a fine structure after rolling becomes difficult, and the toughness falls. This heated steel material may be rolled by recrystallization rolling at 900° C. or more for the purpose of making the austenite finer or may be left without rolling by recrystallization rolling. Next, finishing rolling is used to create steel plate of a predetermined thickness. After rolling, this is water cooled. At this time, the steel is preferably rolled at a temperature of 670° C. to 850° C. by a cumulative rolling rate of 30% or more and started to be cooled from a temperature of 650° C. or more. The cooling rate at this time is preferably 25° C./sec or more at the surfaces of the steel plate and 5° C./sec or more at the center part of the steel plate. Further, sometimes water cooling is switched to air cooling from a temperature of 500° C. or less for the purpose of self tempering. Further, in accordance with need, after cooling, the plate may be tempered and heat treated at a temperature of 300 to 650° C. to adjust the strength and toughness of the matrix material. In this way, ultralow temperature rolling and complicated heat treatment processes are not required, so the high strength thick steel plate according to the present embodiment can be produced with a high productivity and by a low cost. Further, the residual stress is also suppressed, so the increase in cost due to the correction of the shape can also be suppressed. This is therefore preferable.

As explained above, according to the present embodiment, by making the amount of addition of Ni a suitable value to make the crystal grain size of the mainly bainite structure finer and by forming a distribution of texture reducing the area ratio of the {100} planes oriented to a plane vertical to the loading direction, a high strength thick steel plate can be improved in crack arrestability. Further, in steel plate having a yield stress of 390 to 500 MPa and a plate thickness of 40 to 100 mm, the Kca at −10° C. showing the crack arrestability can be made 170 MPa·m$^{0.5}$ or more. Further, the productivity can be raised and the cost lowered.

Examples

In the steelmaking process, the chemical components of molten steels were adjusted, then the steels were continuously cast into cast slabs. The cast slabs were reheated and further rolled to obtain thick steel plates of thicknesses of 40 to 100 mm which were then water cooled. At this time, part of the steel plates were air cooled (comparative examples). After this, in accordance with need, the plates were heat treated to produce thick steel plates of yield strengths of 390 MPa to 500 MPa. Table 1 shows the chemical components of the thick steel plates.

TABLE 1 unit: mass %

| Class | Steel | C | Si | Mn | P | S | Al | Ti | Ni | N | Cu | Cr | Mo | Nb | V | B | Ca | Ma | REM |
|---|---|---|---|---|---|---|---|---|---|---|---|---|---|---|---|---|---|---|---|
| Inv. ex. | 1 | 0.15 | 0.1 | 1.4 | 0.005 | 0.002 | 0.03 | 0.015 | 0.2 | 0.003 | — | — | — | 0.008 | — | — | — | — | 0.003 |
| Inv. ex. | 2 | 0.12 | 0.3 | 1.2 | 0.004 | 0.003 | 0.05 | 0.006 | 0.6 | 0.004 | — | — | — | — | — | — | — | — | — |
| Inv. ex. | 3 | 0.08 | 0.2 | 1.1 | 0.005 | 0.005 | 0.01 | 0.008 | 1.0 | 0.002 | — | — | — | 0.015 | — | 0.001 | 0.001 | — | — |
| Inv. ex. | 4 | 0.05 | 0.1 | 0.7 | 0.003 | 0.004 | 0.01 | 0.014 | 1.4 | 0.006 | 0.8 | — | — | 0.006 | 0.05 | — | — | 0.002 | — |
| Inv. ex. | 5 | 0.03 | 0.2 | 0.6 | 0.002 | 0.004 | 0.04 | 0.012 | 1.8 | 0.005 | 0.5 | 0.5 | 0.5 | 0.025 | — | — | — | — | — |
| Inv. ex. | 6 | 0.04 | 0.1 | 1.9 | 0.005 | 0.003 | 0.03 | 0.010 | 0.4 | 0.004 | — | — | — | — | — | — | 0.002 | — | — |
| Inv. ex. | 7 | 0.05 | 0.3 | 1.8 | 0.005 | 0.003 | 0.03 | 0.012 | 0.5 | 0.003 | — | — | — | — | — | — | — | — | — |
| Inv. ex. | 8 | 0.08 | 0.1 | 1.5 | 0.006 | 0.005 | 0.02 | 0.014 | 0.4 | 0.002 | 0.4 | — | — | 0.006 | — | — | — | — | — |
| Comp. ex. | 9 | 0.08 | 0.2 | 1.1 | 0.005 | 0.005 | 0.01 | 0.008 | 0 | 0.002 | — | — | — | 0.015 | — | 0.001 | 0.001 | — | — |
| Comp. ex. | 10 | 0.13 | 0.2 | 1.2 | 0.005 | 0.002 | 0.03 | 0.015 | 0.1 | 0.005 | — | — | — | 0.015 | 0.05 | — | — | — | 0.004 |
| Comp. ex. | 11 | 0.05 | 0.1 | 1.1 | 0.004 | 0.003 | 0.05 | 0.007 | 1.0 | 0.004 | 0.3 | 0.2 | 0.2 | 0.008 | — | — | — | — | — |
| Comp. ex. | 12 | 0.11 | 0.1 | 0.9 | 0.003 | 0.003 | 0.02 | — | 1.0 | 0.002 | 0.3 | — | — | 0.012 | — | — | — | 0.001 | — |
| Comp. ex. | 13 | 0.12 | 0.2 | 1.6 | 0.004 | 0.004 | 0.01 | 0.010 | 0.3 | 0.004 | — | — | — | — | — | — | 0.001 | 0.001 | — |

The thick steel plates were measured for microstructure phase fractions, mechanical properties, average crystal grain size, and crack arrestability. Among these, as the microstructure phase fractions, an optical microscope was used to photograph the microstructures at a position 5 mm below the surface of the plate thickness and positions at ¼ and ½ of plate thickness by a power of ×400, then image analysis was used to find the average value of the area ratios of the different phases with respect to the measured full field regions at the different positions. Further, as the yield stress (YS) and tensile stress (TS), the average values of two test pieces were found. Further, as the Charpy absorbed energy (vE-40) at −40° C., the average value of three test pieces was found. Further, the average crystal grain size was found by using the EBSP (Electron Back Scattering Pattern) method to measure 500 μm×500 μm regions at 1 μm pitch, preparing a map of grain boundaries with a crystal Disorientation angle with adjoining grains of 15° or more, and finding the circle equivalent diameter of the crystal grains at that time by image analysis. Further, the measured EBSP data was used for analysis of the crystal direction, a map of {100} planes forming an angle of ±15° with respect to the plane vertical to the loading direction was prepared, and the area ratio with respect to the total field region was found by area ratio. Note that the measurement positions of the average crystal grain size and area ratio of the {100} planes are positions about 10% of the plate thickness below the surface of the thick steel plate (below referred to as the "surface layers") and the center part of the plate thickness (below referred to as the "center"). Further, the crack arrestability was tested by a temperature gradient type standard ESSO test (original thickness and plate width of 500 mm respectively). The measurement results of the thick steel plates are shown in Tables 2 and 3 together with the methods of production.

TABLE 2

| | | | Method of production of steel plate | | | | | Microstructure | | |
|---|---|---|---|---|---|---|---|---|---|---|
| | | Plate | Heating | Rolling | Cooling | | Annealing | Area ratio of phases | | |
| | | thickness | temp. | Start | Start | End | temp. | (%) | | |
| Class | Steel | (mm) | (° C.) | (° C.) | (° C.) | (° C.) | (° C.) | Ferrite | Pearlite | Bainite |
| Inv. steel | 1 | 50 | 1150 | 1050 | 800 | 400 | — | 10 | 0 | 90 |
| Inv. steel | 2 | 40 | 1200 | 1100 | 780 | 350 | — | 20 | 10 | 70 |
| Inv. steel | 3 | 80 | 1050 | 950 | 750 | 150 | 630 | 10 | 5 | 85 |
| Inv. steel | 4 | 100 | 1100 | 1000 | 730 | 100 | 580 | 25 | 5 | 70 |
| Inv. steel | 5 | 60 | 1080 | 980 | 770 | 200 | 550 | 30 | 5 | 65 |
| Inv. steel | 6 | 70 | 1020 | 950 | 740 | 300 | — | 15 | 5 | 80 |
| Inv. steel | 7 | 70 | 1200 | 1100 | 770 | 500 | — | 25 | 0 | 75 |
| Inv. steel | 8 | 50 | 1050 | 950 | 700 | 150 | 500 | 30 | 5 | 65 |
| Comp. steel | 9 | 80 | 1150 | 1050 | 750 | 150 | 630 | 20 | 10 | 70 |
| Comp. steel | 10 | 40 | 1250 | 1150 | 780 | 200 | 580 | 15 | 5 | 80 |
| Comp. steel | 11 | 60 | 1100 | 1000 | Air cooling | | — | 40 | 20 | 40 |
| Comp. steel | 12 | 100 | 1050 | 950 | 800 | 400 | — | 10 | 0 | 90 |
| Comp. steel | 13 | 90 | 1150 | 1100 | 820 | 300 | — | 10 | 5 | 85 |

TABLE 3

(Continuation of Table 2)

| Class | Steel | Matrix-t/2 [1] YS (MPa) | TS (MPa) | vE-40 (J) | Average crystal grain size[2] Surface layer (μm) | Center (μm) | (100) area ratio[3] Surface layer (%) | Center (%) | Crack arrestability [4] Kca at −10° C. (MPa √m) |
|---|---|---|---|---|---|---|---|---|---|
| Inv. steel | 1 | 480 | 630 | 200 | 12 | 35 | 20 | 5 | 240 |
| Inv. steel | 2 | 395 | 530 | 200 | 10 | 30 | 18 | 10 | 250 |
| Inv. steel | 3 | 470 | 600 | 250 | 6 | 18 | 14 | 6 | 200 |
| Inv. steel | 4 | 420 | 580 | 240 | 6 | 16 | 25 | 12 | 195 |
| Inv. steel | 5 | 440 | 550 | 250 | 9 | 17 | 15 | 7 | 220 |
| Inv. steel | 6 | 465 | 590 | 300 | 7 | 25 | 17 | 8 | 210 |
| Inv. steel | 7 | 400 | 540 | 220 | 14 | 30 | 34 | 16 | 170 |
| Inv. steel | 8 | 480 | 640 | 300 | 6 | 15 | 40 | 10 | 180 |
| Comp. steel | 9 | 440 | 550 | 200 | 20 | 45 | 35 | 10 | 80 |
| Comp. steel | 10 | 490 | 610 | 180 | 18 | 42 | 25 | 4 | 95 |
| Comp. steel | 11 | 390 | 520 | 250 | 25 | 28 | 32 | 9 | 75 |
| Comp. steel | 12 | 420 | 560 | 250 | 20 | 35 | 19 | 18 | 120 |
| Comp. steel | 13 | 410 | 530 | 100 | 12 | 50 | 16 | 5 | 150 |

[1] Center position in plate thickness, YS and TS are average values of two test pieces, Charpy absorbed energy (vE-40) at −40° C. is average value of three test pieces.
[2] Circle equivalent diameter of crystal grains surrounded by grain boundary of misorientation angle of 15° or more with adjoining grains by EBSP method.
[3] Area ratio of (100) crystal planes forming angle of ±15° with respect to plane vertical to loading direction by EBSP method.
[4] Value of Kca at −10° C. in temperature gradient type standard ESSO test (original thickness, plate width 500 mm).

Steels 1 to 8 satisfy the requirements of the present invention in chemical components and crystal grain size, so had Kca at −10° C. showing the crack arrestability of superior values of 170 MPa·m$^{0.5}$ or more. In particular, Steels 1 to 6 satisfy the requirements of the present invention in {100} area ratio, so exhibited superior values of 195 MPa·m$^{0.5}$ or more. Further, they exhibit mainly bainite microstructures and have as mechanical properties yield strengths (YS) of 395 to 480 MPa and tensile strengths (TS) of 530 to 640 MPa—all high values.

As opposed to this, steels 9 and 10 have amounts of addition of Ni of 0% and 0.1% or lower than the lower limit of the present invention. As a result, the crystal grain size at both the surface layer and the center part is over the upper limit of the range of the present invention. Further, Steel 9 has an {100} area ratio at the surface layer parts over the upper limit of the range of the present invention. For this reason, they exhibited a Kca at −10° C. of a low value of 80 to 95 MPa·m$^{0.5}$.

Further, Steel 11 has chemical components satisfying the present invention requirements, but has a crystal grain size and {100} area ratio at the surface layer parts over the upper limit of the range of the present invention. For this reason, it exhibited a Kca at −10° C. of a low value of 75 MPa·m$^{0.5}$.

Further, Steel 12 does not satisfy the requirements of the present invention in the Ti of the chemical components, so the crystal grain size is over the upper limit of the range of the present invention at the surface layer parts. Further, it has an {100} area ratio at the center part over the upper limit of the range of the present invention. For this reason, it exhibited a Kca at −10° C. of a low value of 120 MPa·m$^{0.5}$.

Further, Steel 13 satisfies the requirements of the present invention in chemical components and crystal grain size of the surface layer parts, but has a crystal grain size of the center part higher than the upper limit of the present invention For this reason, even if it satisfies the requirements of the present invention in the {100} area ratio, the Kca at −10° C. becomes 150 MPa·m$^{0.5}$ and a high crack arrestability could not be exhibited.

From the above embodiments, it was confirmed that by application of the present invention, high strength thick steel plate superior in crack arrestability having a yield stress of 390 to 500 MPa, having a plate thickness of 40 to 100 mm, having a structure mainly comprised of bainite, and having a Kca at −10° C. of 170 MPa·m$^{0.5}$ or more can be provided.

Further, the present invention is not limited to the above embodiments and can be carried out changed in various ways in the range not deviating from the main gist of the present invention.

INDUSTRIAL APPLICABILITY

The present invention can provide thick steel plate superior in crack arrestability, high in yield stress, and having a plate thickness of 40 mm or more at a low cost and can meet the demands for safety and lower cost in shipbuilding, tanks, buildings, and other large sized structures, so has great industrial applicability

The invention claimed is:

1. High strength thick steel plate containing, by mass %, C: 0.03 to 0.15%, Si: 0.1 to 0.5%, Mn: 0.5 to 2.0%, P: ≦0.02%, S: ≦0.01%, Al: 0.001 to 0.1%, Ti: 0.005 to 0.02%, Ni: 0.15 to 2%, and N: 0.001 to 0.008% and having a balance of iron and unavoidable impurities as chemical components, having a microstructure of a ferrite and/or pearlite structure with bainite as a matrix phase, and having an average circle equivalent diameter of crystal grains with a crystal misorientation angle of 15° or more of 15 μm or less in the regions of 10% of plate thickness from the front and rear surfaces and of 40 μm or less in the other region including the center part of plate thickness.

2. High strength thick steel plate superior in crack arrestability as set forth in claim 1 characterized by further containing, by mass %, one or more of Cu: 0.1 to 1%, Cr: 0.1 to 1%, Mo: 0.05 to 0.5%, Nb: 0.005 to 0.05%, V: 0.02 to 0.15%, and B: 0.0003 to 0.003% as chemical components.

3. High strength thick steel plate superior in crack arrestability as set forth in claim 1 characterized by further containing, by mass %, one or more of Ca: 0.0003 to 0.005%, Mg; 0.0003 to 0.005%, and REM: 0.0003 to 0.005% as chemical components.

4. High strength thick steel plate superior in crack arrestability as set forth in any one of claims 1 to 3 wherein {100} planes forming an angle of ±15° with respect to a plane vertical to loading direction have an area ratio of 30% or less in said regions of 10% of plate thickness from the front and rear surfaces.

5. High strength thick steel plate superior in crack arrestability as set forth in any one of claims 1 to 3 wherein said {100} planes forming an angle of 15° with respect to the plane vertical to loading direction have an area ratio of 15% or less in said regions including the center part of plate thickness other than said regions of 10% of plate thickness from the front and rear surfaces.

6. High strength thick steel plate superior in crack arrestability as set forth in any one of claims 1 to 3 wherein the plate thickness is 40 mm or more.

7. High strength thick steel plate superior in crack arrestability as set forth in any one of claims 1 to 3 wherein the yield stress is 390 MPa or more.

* * * * *